US005402698A

United States Patent [19]

Morrison

[11] Patent Number: 5,402,698

[45] Date of Patent: Apr. 4, 1995

[54] METHOD FOR SYCHRONIZING TOOLING IN A DIE-CUTTING MACHINE FOR GENERATING DIE-CUT BLANKS

[75] Inventor: Richard E. Morrison, Amherst, N.Y.

[73] Assignee: Die-X Tooling Systems, Amherst, N.Y.

[21] Appl. No.: 48,365

[22] Filed: Apr. 15, 1993

[51] Int. Cl.[6] ..... B26D 1/06; B26D 7/18

[52] U.S. Cl. ..... 83/39; 83/13; 83/55; 83/405; 225/97; 493/342; 493/373

[58] Field of Search ..... 83/13, 55, 405, 651, 83/697, 701, 821, 856, 857, 39, 40, 50, 52, 111, 560; 225/97, 103; 493/342, 363, 373, 372

[56] References Cited

U.S. PATENT DOCUMENTS

| | | | |
|---|---|---|---|
| 2,504,642 | 4/1950 | Burgess | 83/13 X |
| 3,137,218 | 6/1964 | Elliott | 493/372 X |
| 5,179,882 | 1/1993 | Takeuchi et al. | 493/342 X |

FOREIGN PATENT DOCUMENTS

| | | | |
|---|---|---|---|
| 3336796 | 4/1985 | Germany | 493/373 |

*Primary Examiner*—Eugenia Jones
*Attorney, Agent, or Firm*—Phillips, Lytle, Hitchcock, Blaine & Huber

[57] ABSTRACT

A method for aligning the process tools of a typical box blank die-cutting machine. The method contemplates the use of alignment openings 21 and 22 on the surface of male and female tools 19 and 20 corresponding to a cut through-hole 16 on test sheet 14. As test sheet is urged through the process, a series of alignment cylinders, 18, 24 are used to insure each of the male and female tools and test sheet are aligned by having the alignment cylinders fall cleaning through the various alignment openings and through-hole. Once the tools at each position of the process are aligned, alignment screws 31 and alignment members 28 on the machine frame 25 serve to fix the position of the tools relative to the position of the sheets to be die-cut, stripped and blanked. Accordingly, the method contemplates alignment and set-up of the machine based upon the urged position of the sheets to be etched and cut.

6 Claims, 5 Drawing Sheets

Fig. 5.
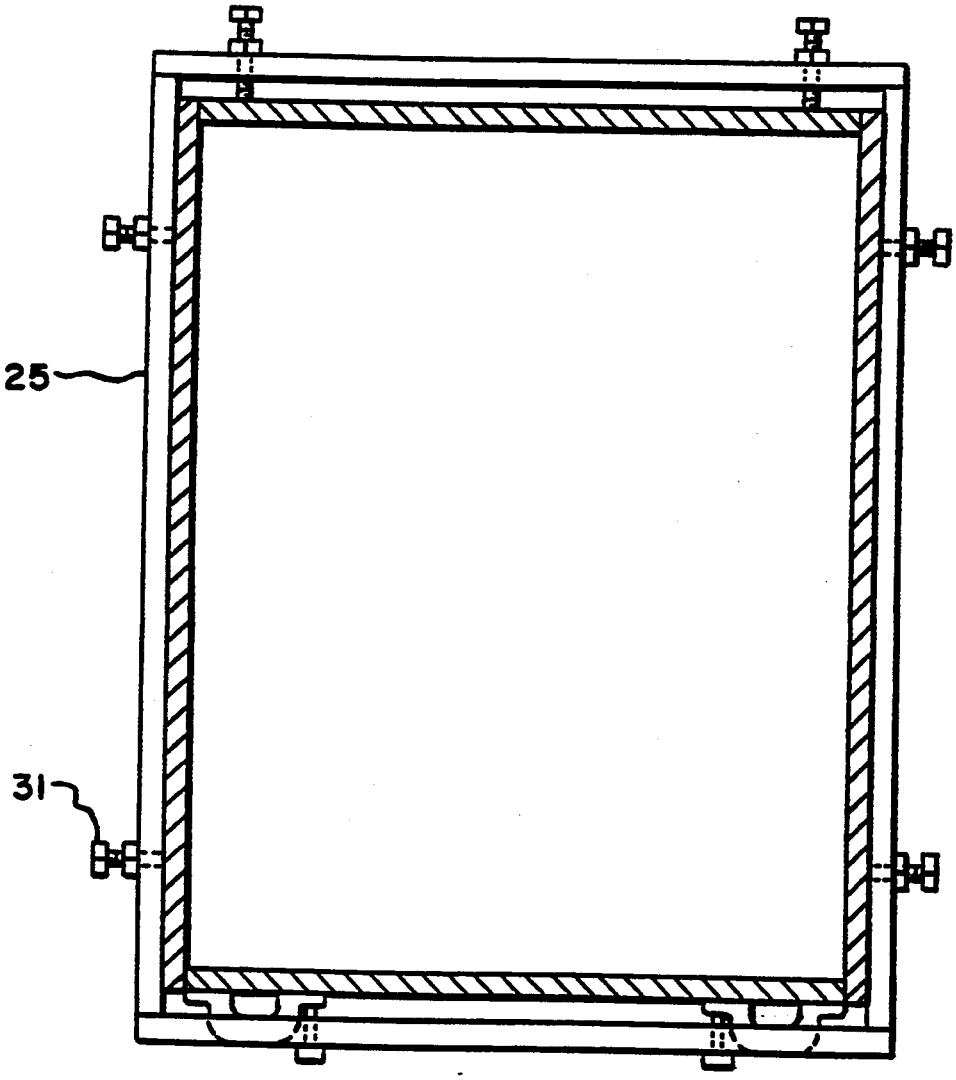
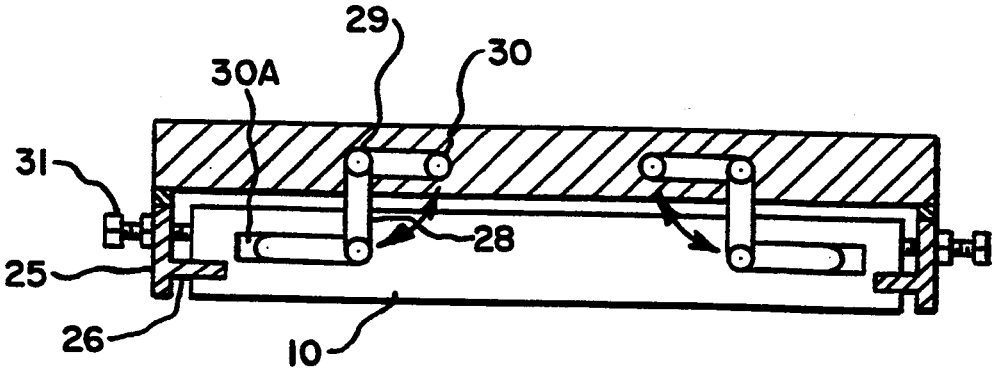
Fig. 6.

Fig. 7.
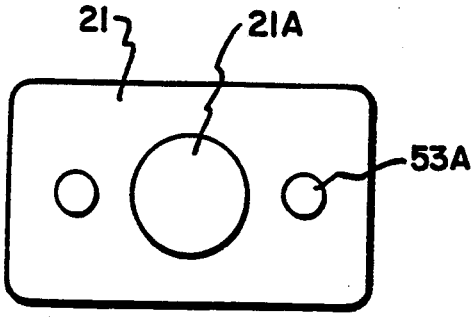
Fig. 8.
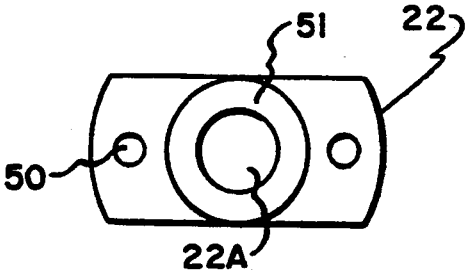
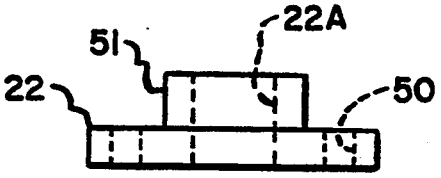
Fig. 9.
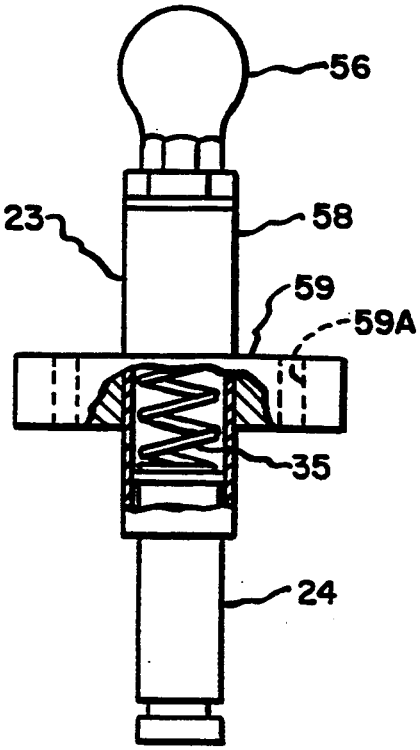
Fig. 10.
Fig. 11.
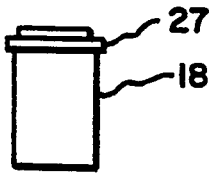
Fig. 14.
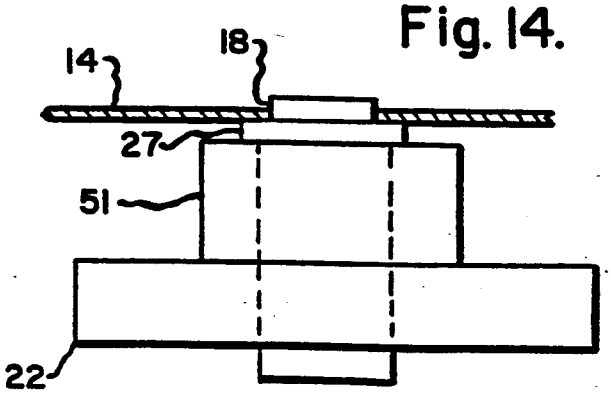

METHOD FOR SYCHRONIZING TOOLING IN A DIE-CUTTING MACHINE FOR GENERATING DIE-CUT BLANKS

TECHNICAL FIELD

The present invention relates generally to an improved method for aligning male and female stripping and blanking tools of a die-cutting machine and, in particular, to an improved method for exact synchronization of various male and female tools of a die-cutting machine used to cut and generate box blanks from paperboard or other suitable materials.

BACKGROUND OF THE INVENTION

With the advent of many different sizes, shapes and configurations of paperboard or similar type containers, it is well-known in the art to die-cut, strip and blank paperboard box blanks using an automatic sequential press or die-cutting machine. By automating the process and by using computer-aided technology, it is now possible to configure die-cut blanks in a limitless number of dimensions and specifications and, as well, to lay-out any number of blanks on a single sheet of paperboard while automatically cutting, stripping and blanking the sheets with little or no human operator intervention. The typical system and press known in the art is discussed in pending U.S. patent application Ser. No. 07/899,427 filed on Jun. 16, 1992.

The general configuration of automatic die-cutting machines for the production of die-cut blanks is well-known. In particular, a sheet of box blank material, usually paperboard, is automatically interposed or urged by mechanical means beneath the surface of a cutting die as part of the first stage of the process. The cutting die comprises a planar die having specially configured cutting edges created through the use of computer and laser technology to reflect a particular series of die-cut blank lay-outs for cutting. Once a sheet is interposed under the cutting die on a cutting platen, the cutting die is pressed onto the sheet from below thereby causing the sheet to be "cut" or "etched" by the cutting die thereabove.

After the initial cutting process, the entire cut or etched sheet is automatically pulled or urged into a second station of the process for the stripping away of most of the excess material from around the cut box blanks. This is referred to as the stripping station. The stripping process comprises a female stripping tool onto which the cut sheet is automatically interposed. The female stripping tool has a series of configured openings corresponding to the etched portions of the cut sheet and is adapted to receive from above the male stripping tool. The male stripping tool cooperating with the female stripping tool, effectively breaks away and separates from the box blanks the majority of excess material by urging downward onto the sheet arranged over the female stripping tool. It is, of course, critical that the male and female stripping tools are aligned precisely and that the cut sheet is arranged in alignment therebetween to insure that stripping is effectively accomplished without tearing of the box blank, jamming of the machine or damage thereto. Further, precise alignment is required on account of the narrow tolerances necessary to assemble the box or container formed from the cut sheet.

On machines so configured in the generally known process, the stripped sheet is next urged in between yet another series of male and female blanking tools arranged one above the other, again required to be in precise alignment. The female blanking tool is adapted to receive thereabove the die-cut blank stripped at the previous station and has a series of openings directly corresponding to the shapes of the cut boxes to be blanked. In turn, the corresponding male blanking tool of similar contour to that of the female tool is adapted to push the cut box blanks free from any remaining extraneous material and through the female blanking tool into a stack therebelow. Accordingly, it is once again required that the male and female blanking tools be carefully aligned and that the sheet to be blanked is precisely arranged therebetween to avoid problems similar to those described in the stripping portion of the operation. After blanking is completed, the remaining extraneous material is then urged off the face of the female blanking tool into a refuse area and the process continues from the beginning.

In normal operation of the box blank die-cutting machines, each of the tools is interposed one above the other in the machine at each station. In general, the tools are slided into the machine or press from the side and locked into position using a series of positioning screws on each side and a locking mechanism at the end. The pressure and extent of the positioning screws may be varied somewhat thereby permitting each of the tools to be rearranged and articulated to a degree within the machine. Other machines employ similar, but not identical, methods for aligning the tools. For example, the Bobst® center line method is well known in the art and comprises a series of alignment notches on the tool and corresponding pegs interposed on the machine frame for initially centering the tool. This centering mechanism nonetheless permits the tool to be articulated in the directions necessary to achieve alignment. All of these methods, and others not disclosed here, are well-known in the art and are equally adaptable for use with the instant invention.

The invention contemplates, however, that the operator will generally align each of the tools using a test sheet and the locking and adjustment screws or other alignment means of the machine for each step of the process. For example, in the prior art, an operator will cut a single sheet as a sample and urge the sheet onto the female stripping tool. The operator will then adjust the female stripping tool "by eye" using the available adjustment means, whether the Bobst® center line system or other systems, so that the cut sheet is properly interposed over the female stripping tool. Even this initial step is usually very time consuming since the operator must carefully insure the female stripping tool is aligned with the cut sheet. Small adjustments in the alignment means must be made by hand and the results reviewed until the operator is satisfied the female stripping tool is properly aligned with the die cut sheet. The operator must then repeat the entire procedure by lowering the male stripping tool over the female stripping tool to insure engagement is precise and does not affect or damage the cut sheet. Again, the male stripping tool is positioned using the eyes of the operator and the particular manual alignment means available on the machine at hand. After the stripping station is properly aligned, i.e., after each of the female stripping tool, male stripping tool and die cut sheet are aligned for proper engagement, the operator continues set-up of the machine by urging a test sheet over the female blanking tool at the next stage of the process. The time consuming and exact steps employed for the stripping portion of the process are repeated, verbatim, for the blanking operation. The operator by hand and through an eye view of the components insures their alignment and complete set-up of the machine.

Accordingly, it is well known and recognized in the prior art that set-up of the box blank cutting machine is critical to efficient and proper automatic cutting, stripping and blanking of multiple box blanks. The alignment method currently practiced in the art is a manual one relying upon the senses and vision of the operator in manual adjustment of the stripping and blanking tools through use of the applicable alignment means of a particular machine press. Accordingly, it is not unusual for machine set-up to take anywhere from four to six hours, especially for complex box layouts comprising various series of boxes and orientations. On account of the precision required and the high tolerances of the components, the method of manually setting up the machine may require that the machine be "down" for extended periods of time between production runs. This, of course, results in diminished capacity and productivity and affects the overall cost of production and price of the box blanks.

Accordingly, the present invention contemplates a set-up and alignment method for automatic box blank die-cutting machines that greatly reduces the set-up time by minimizing burdensome requirements on the operator and instead, employs a series of specially configured tools and alignment devices adapted to quickly and easily insure precise and accurate alignment of the system components. This improved method of alignment and set-up, in turn, reduces "down time" dramatically, increases productivity and ultimately lowers the production cost of the resulting die-cut box blanks.

DESCRIPTION OF THE DRAWINGS

FIG. 5 is a top plan view of the die-cutting machine frame and removable tool.

FIG. 6 is a side view of the die-cutting machine frame and inserted tool.

FIG. 7 is a top plan view of a male tool alignment bushing of specific diameter.

FIG. 8 is a top plan view of a female alignment member of specific diameter.

FIG. 9 is a transverse sectional view of a female alignment member.

FIG. 10 is a side view of a spring loaded male tool alignment cylinder.

FIG. 11 is a side view of a sheet alignment cylinder.

FIG. 14 is a transverse sectional view of a sheet alignment cylinder engaged and interposed within the female alignment member with a sheet interposed there over.

BRIEF DESCRIPTION OF THE INVENTION

Figure 1:
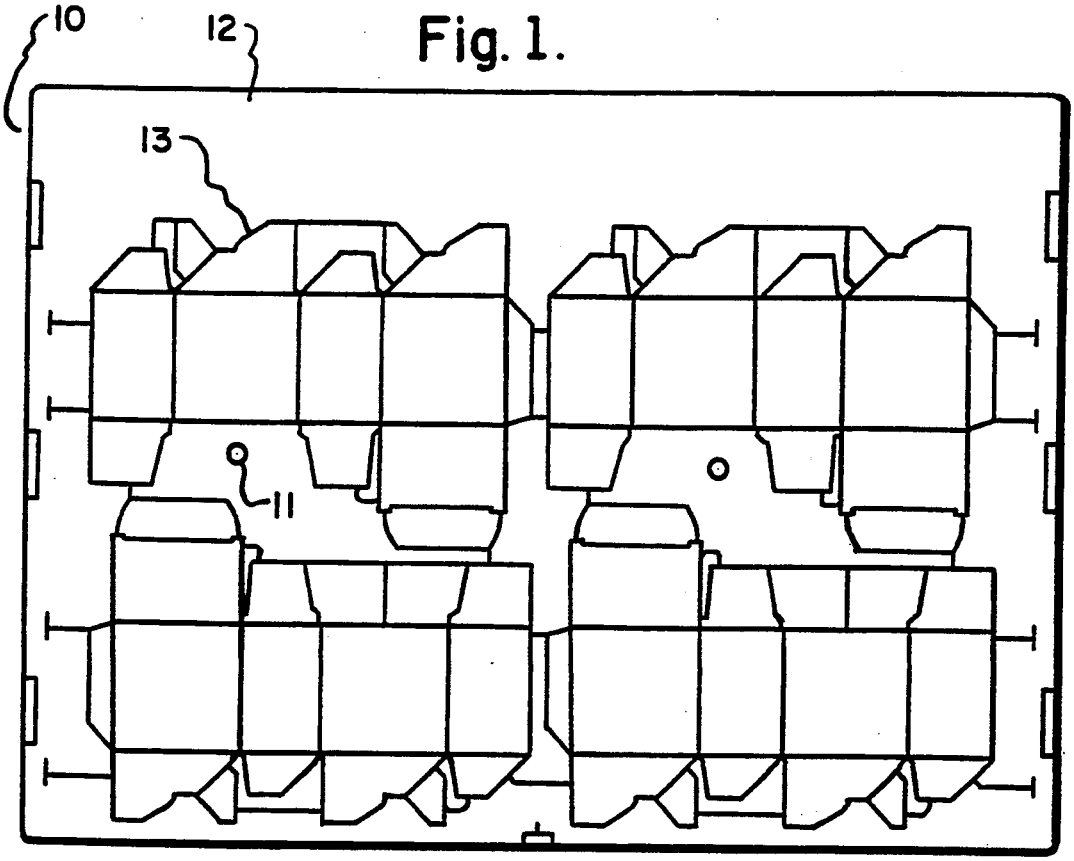
FIG. 1 is a top plan view of the cutting tool showing a layout of four identical boxes for cutting.

The present invention contemplates an improved method for the alignment and set-up of a die-cutting machine for the cutting and blanking of boxes from paperboard or card stock sheets.

The improved method contemplates providing a cutting tool (e.g. 10) having a series of circular cutting edges (e.g. 11) interposed along the surface (e.g. 12) of the tool.

The cutting tool is adapted to automatically receive a planar sheet (e.g. 14) to be die-cut or etched into a plurality of connected box blanks (e.g. 15) and further, to include alignment through-holes (e.g. 16) corresponding to a series of cutting cylinders on the surface of the cutting tool.

The method contemplates automatically positioning a sample sheet under the cutting tool on top of a planar platen adapted to articulate upward thereby causing the planar sheet to be cut into a sample box form including the through-holes and which corresponds to the lay-out of the cutting tool.

The method next contemplates automatic urging of the sample cut sheet, including alignment through holes (e.g. 16), into later stages of the box blanking process. For example, the planar sheet may next be automatically urged over the face of a female stripping tool (e.g. 20) having corresponding edges (e.g. 27) for stripping excess material off of the planar sheet. The female stripping tool is arranged to face thereabove a male stripping tool (e.g. 19) having corresponding stripping portions (e.g. 37) operatively arranged to engage the female stripping apertures for punching out the excess material from the die-cut planar sheet.

The method further contemplates interposition on the surface of the female stripping tool a series of exactly dimensioned alignment members (e.g. 22) of preselected diameter (e.g. 22A) and corresponding, when in alignment, to the through-holes of the planar sheet.

Similarly, the male stripping tool includes an identically located series of male alignment bushings (e.g. 21) having a preselected diameter (e.g. 21A) and interposed along its surface, corresponding, when in perfect alignment, with the through-holes of the planar sheet and female alignment member and openings.

Each of the tools is arranged within the machine frame (e.g. 25) in sliding engagement and is adjustable therein through the use of adjustment screws (e.g. 31) and locking means (e.g. 28) on the outside edge thereof. Accordingly, each of the tools may be articulated within the machine in all directions to achieve set-up and alignment.

After the sample sheet has been die-cut in the platen area of the press, the sample sheet is urged into position over the female stripping tool. By manipulating the frame alignment means, whether alignment screws as shown in the embodiment of the drawings, the Bobst ® center line method or any other alignment means, the alignment cylinder is placed through the female stripping tool alignment member openings. Thereafter, the test sheet is placed over the engaged alignment cylinder and female stripping tool and, if the test sheet through-holes drop cleanly onto the collar of the alignment cylinder, the female stripping tool is locked into place using the locking means of the machine frame or mounting brackets. Accordingly, the stripping tool and subsequent die-cut sheets will be properly aligned to insure efficient and accurate stripping of the die-cut blanks.

The method then contemplates facing of the male stripping tool over the aligned female stripping tool. The male stripping tool includes at positions identical to those of the alignment member openings of the female stripping tool, a spring loaded alignment cylinder (e.g. 23) operatively arranged to drop through the alignment member opening of the male stripping tool (e.g. 21), and the alignment member openings of the female stripping tool when both are in alignment. The method provides that the operator uses the frame alignment means and/or locking mechanism to insure the male stripping tool is in proper engagement through use of the spring loaded alignment cylinder of the male stripping tool. When the alignment cylinder, in its engaged position, passes through each of the elements cleanly and freely, then the tools are aligned for purposes of operation.

The method of alignment is repeated for each set of male and female tools, whether stripping, blanking or otherwise, until the entire machine process is aligned or set up as indicated. A production run may then be initiated after all of the tools have been locked into aligned position using the applicable locking mechanism of the machine at hand.

Accordingly, one of the objectives of the present invention is to provide a method for synchronizing a die-cutting machine from station to station for the cutting, stripping and blanking of die-cut blanks.

Still another object of the invention is to provide a method for synchronizing a die-cutting machine that is highly accurate, yet easily accomplished by a single operator.

Still another object of the invention is to provide a method for synchronizing a die-cutting machine that is easily adapted to various die configurations on the layout of box blanks.

Yet another object of the invention is to provide a method for synchronizing a die-cutting machine that diminishes the down time and can be accomplished by a single operator during a very short working period. These and other objects of the invention will be readily apparent from the foregoing and ongoing specification and claims to one of ordinary skill in the art.

MODE(S) OF CARRYING OUT THE INVENTION

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The present invention contemplates a method for synchronizing or setting up the various tools (e.g. stripping and blanking) of a die-cutting machine or press. The present invention contemplates a set-up or synchronizing method that is precise and efficient, yet involves less operator intervention and possibility of error.

The method generally comprises use of a test sheet having thereon a series of alignment openings corresponding to similar openings on the surface of the tools of the sequential machine process. As the test sheet is automatically urged over each of the sequential die tool components, through the use of well-known means such as an automatic gripper or otherwise, the operator aligns or sets-up each stage of the machine to insure proper operation during the cutting, stripping and blanking processes of production.

Adverting first to FIG. 1, a typical cutting die, 10, as shown as having four identical box blanks defined by specially configured cutting edges, 13, laid out across the cutting die planar surface, 12. Cutting edges 13 are adapted to etch or cut a box blank from material interposed under the surface thereof and pressed against the stationary cutting tool. The planar material sheet is interposed below the stationary cutting tool on a planar platen (not shown) that is adapted to move toward the cutting tool from below.

Cutting die 10, typically the first stage of a box blank cutting process and machine, is well-known in the art, as is the use of a moveable planar platen for urging the material to be cut against the cutting tool. The improved alignment method, however, also includes along the surface of cutting die 10 a series of specially placed alignment cutting cylinders, 11, of preselected diameter and not included in the prior art. The cutting cylinders, 11, are interposed between areas of actual box blanks as shown in FIG. 1 and accordingly, do not interfere with ultimate blanking and assembly of the box blanks. The cutting cylinders are, however, adapted to cut into the box blank material interposed onto the surface of the stationary cutting tool in a manner identical to cutting edges 13.

Turning to FIGS. 5 and 6, each of the tools employed in the process, whether male or female, is inserted into facing frames made a part of the machinery. This is well known in the art. When a particular process, such as stripping or blanking, requires a male and female tool, the frames are placed one over another and are adapted to press together to perform a particular function.

FIGS. 5 and 6 illustrate interposition of a particular tool, for example, male stripping tool 19, interposed in a removable frame, into the machine frame 25. The framed tools are supported in the machine by flanges 26 and are capable of being positioned and articulated in all directions within the machine through the use of positioning screws 31. The positioning screws, one of various means for aligning the tools well-known in the art may be manually positioned against the tool to "lock" the tool in position within the confines of the machine frame. When the tool is positioned as required by the operator, it is finally "locked" into place using a pivoting lock member, 28, at the end thereof. Pivoting lock member 28 pivots around a point 29 on the machine frame and, at its other end, 30, is adapted to swing downward against a specially configured locking edge, 30A, on the tool frame edge. Placement and locking of the tools into the machine frame is well-known in the prior art and is a standard feature of most die-cutting machines used with the automatic cutting, stripping and blanking of boxes. As set forth above, aside from the locking mechanism shown in the preferred embodiment of the invention, there are numerous other locking mechanisms including the Bobst® center line locking mechanism well-known in the prior art. The preferred embodiment illustrated here is used to demonstrate how the tools are typically oriented within the machine frame as part of the alignment or set-up process previously employed in the art.

The improved method for setting up and aligning the tools proceeds sequentially through the machine starting with the male and female stripping tools, through the blanking tools required to complete the process depending upon the specific application.

Figure 3:
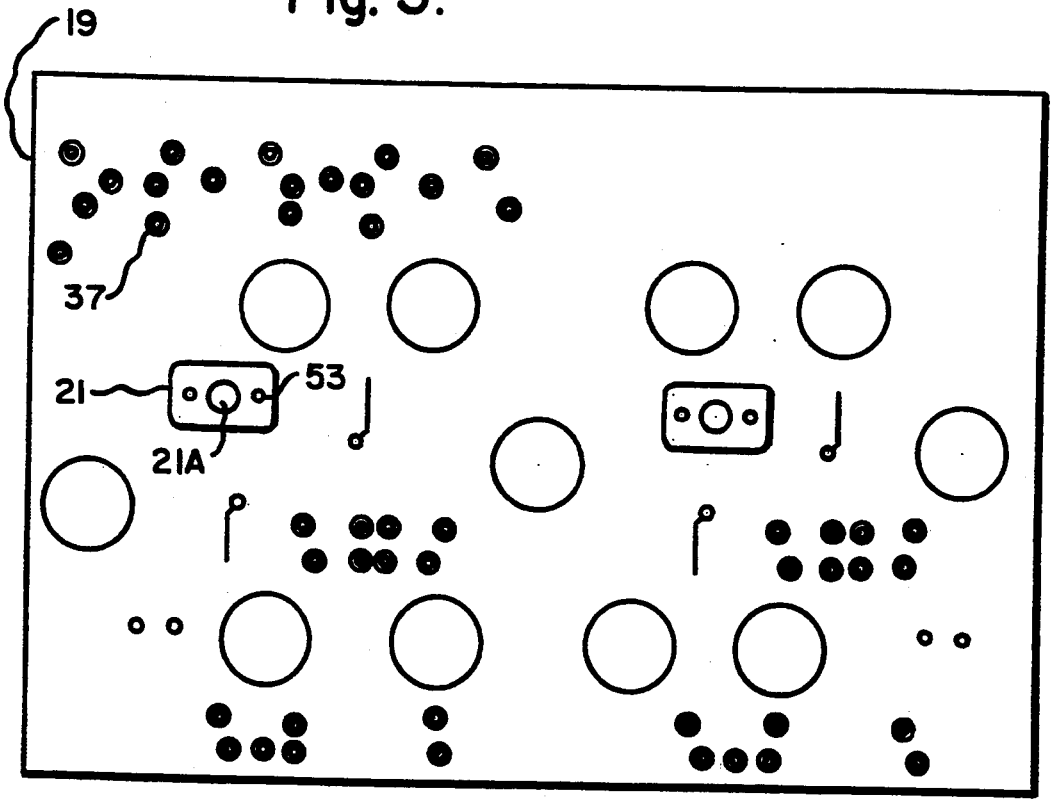
FIG. 3 is a top plan view of the male stripping tool.
Figure 4:
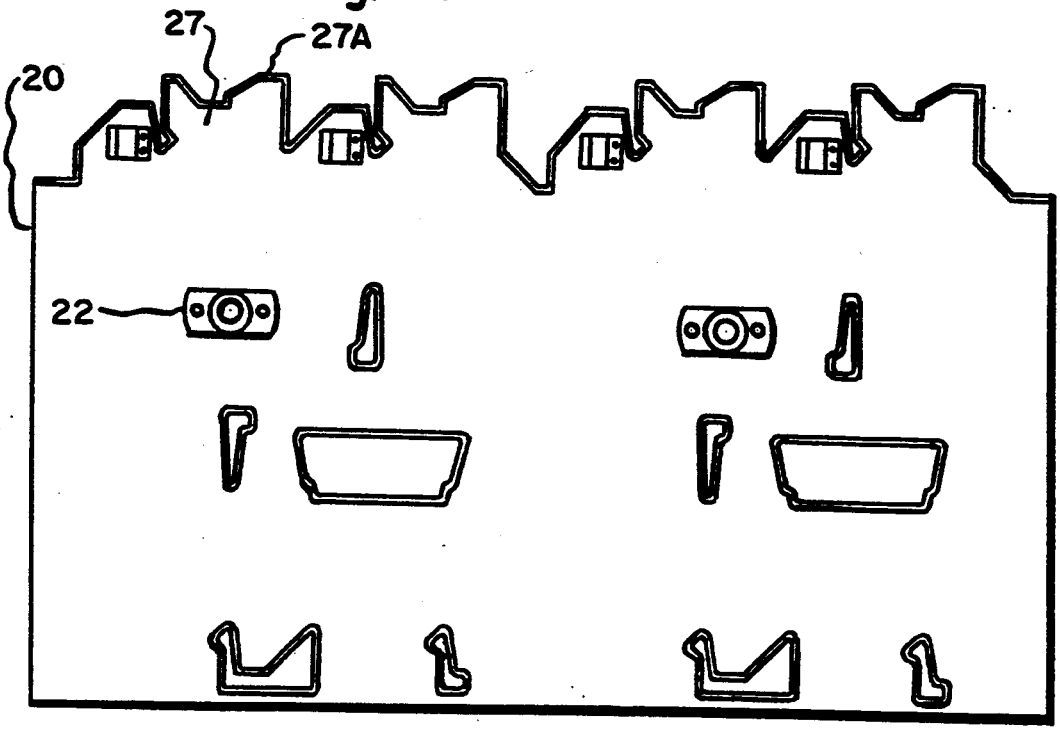
FIG. 4 is a top plan view of the female stripping tool.

For illustration purposes, FIGS. 3 and 4 depict a pair of male and female stripping tools used in the process. It is important to recognize, however, as stated above, that the identical alignment procedure would apply to each pair of tools vertically disposed in the machine and process, depending upon the function to be performed.

Figure 2:
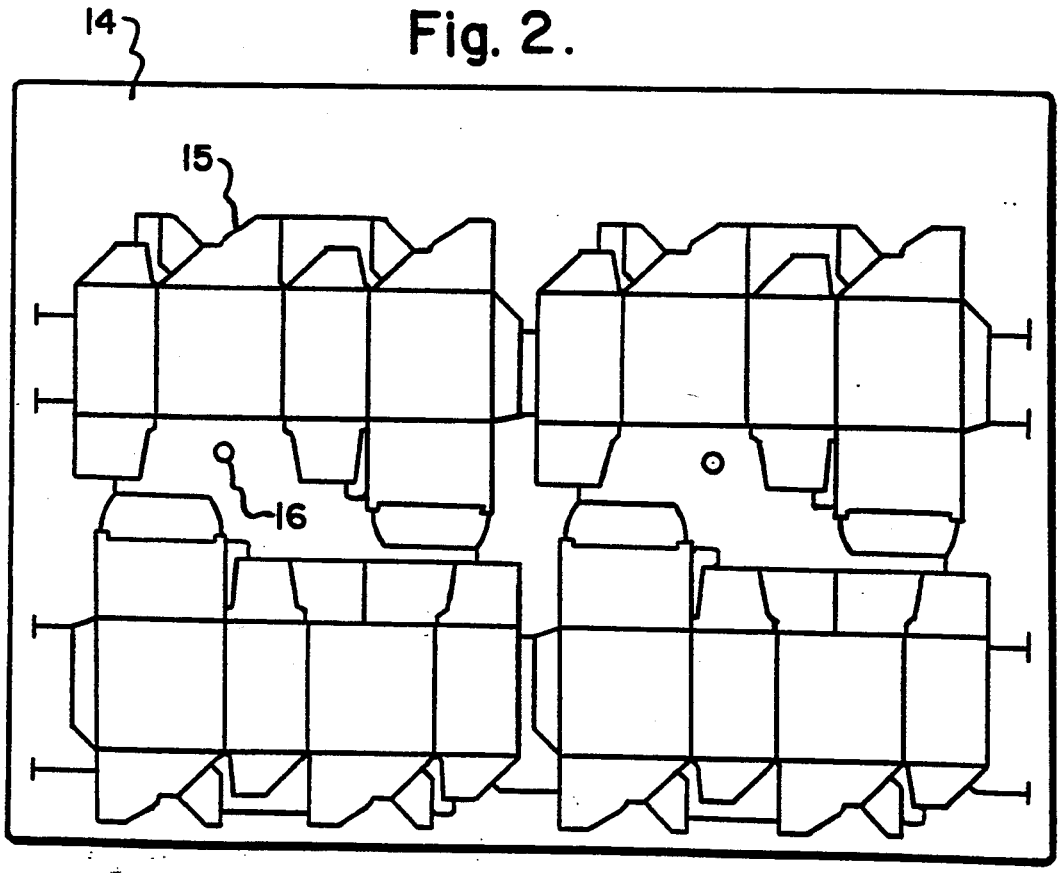
FIG. 2 is a top plan view of a die-cut sheet corresponding to the cutting die of FIG. 1 and having alignment openings thereon.

Adverting now to FIG. 2, test sheet 14 is illustrated and described. In particular, test sheet 14 is a planar sheet of paperboard, paper or other material adapted to be cut or etched during the process into the shape of unassembled box blanks, 15. FIG. 2 shows sheet 14 after it has been urged under and against the cutting die of FIG. 1 by movement of the platen (not shown) and after it has been cut or etched. Accordingly, sheet 14 includes a series of box blanks 15 in cut form and also, includes an aligning through-hole, 16, created by alignment cutting edge 11. Accordingly, the first step of the method contemplates urging a test sheet under the cutting die, including the aligning cutting edge 11, and die-cutting the test sheet thereby producing a typical series of box blanks 15 and the alignment through-hole 16 used to align the remaining sequentially ordered tools in the process.

Once the test sheet has been die-cut, the test sheet is then automatically urged to the next station of the process, the female stripping tool and its companion male stripping tool thereabove. It is important to recognize that the test sheet is urged over the tools through the use of the particular automatic feeding mechanism or urging mechanism for a machine or press, since the feeding mechanism will determine where the test sheet and any resulting production sheets will be positioned during operation. Thus, under the improved method of alignment and set-up of the machine, it is the position of the sheets to be etched and cut that determines alignment of the underlying tools, rather than vice versa. This simplifies alignment and set-up.

Adverting to FIGS. 3 and 4, male and female stripping tools 19 and 20 are illustrated. In particular, FIG. 4 shows a female stripping tool to include a series of openings 27 defined by various cutting edges 27A that are substantially identical to the shape of the etched and cut box blanks of the sheet as produced by the cutting die 10. In turn, FIG. 3 illustrates male stripping tool 19 having a series of similar stripping members, 37, adapted to, when interposed through the female stripping tool, strip a portion of the excess sheet away from the etched and box blanks. Edges 27A define part of the stripping function of the female stripping tool. This process is, too, well-known in the prior art and is a typical method for initially separating the waste portion of the etched sheet from the actual box blanks during the course of the process.

Adverting to FIG. 4, the improved alignment method contemplates the addition of a female stripping tool alignment member, 22, interposed along the surface of the female stripping tool. FIGS. 8 and 9 show the female stripping alignment member to include a body portion having screw holes 50 for affixing the member to the female tool and a raised collar portion 51 having an opening of diameter 22A therethrough. The female stripping tool alignment member is affixed flush with the surface of the female stripping tool at a position substantially identical to sheet through-hole 16. Moreover, the diameter of sheet through-hole 16 and the diameter of the female stripping tool alignment member 22A are also nearly identical. As depicted in the bottom portion of FIG. 13, the female stripping tool alignment member is bolted to the underside of the stripping die and the opening diameter 22A resides along the surface thereof.

Adverting to FIG. 3, male stripping tool 19 also includes on its surface at points nearly identical to that of the female stripping tool and test sheet, a male stripping tool alignment member 21 having opening 21A. FIG. 7 describes the male stripping tool alignment member to be a basically rectangular apparatus capable of being affixed to the surface of the male stripping tool through screw holes 53 and having an opening therethrough.

Opening diameter 21A is necessarily identical to female stripping die alignment member opening diameter 22A and the diameter of sheet through-hole 16. Accordingly when the male stripping tool, female stripping tool and sheet are in vertical alignment, the various openings should form a vertical path therethrough. As well, the etched and cut box blanks on sheet 14, and the various etched surfaces of the stripping tools, should also align perfectly for stripping or, alternatively, blanking.

Figure 13:
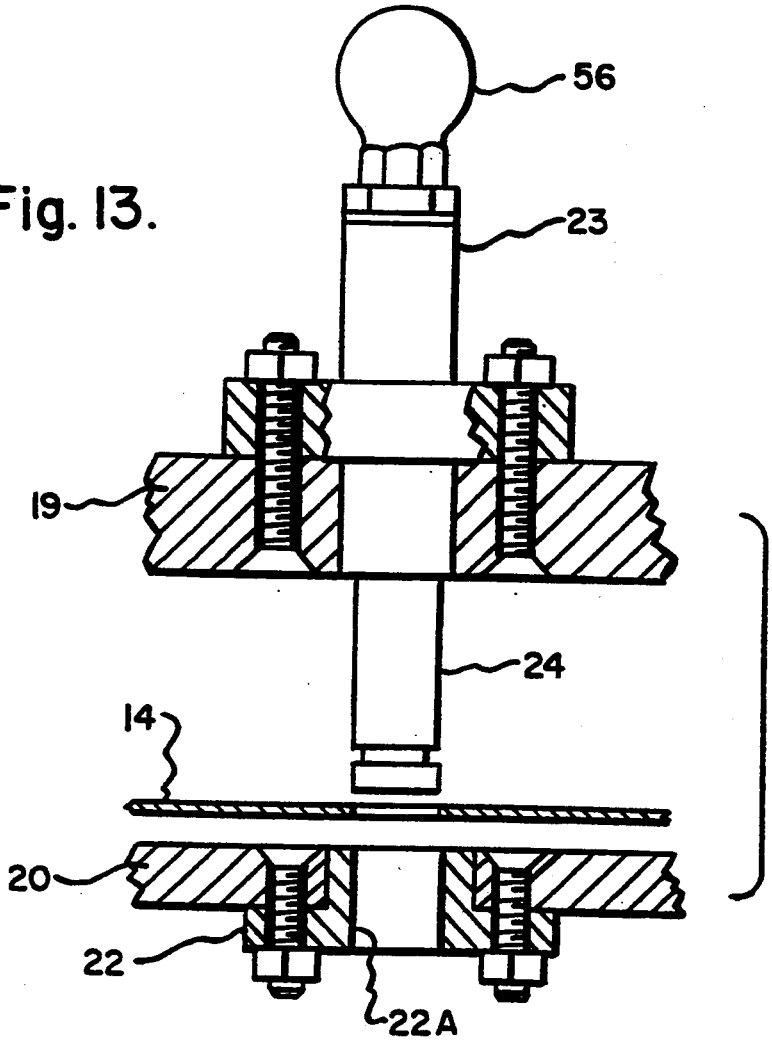
FIG. 13 is a partial sectional side view of a male tool, female tool and sheet demonstrating alignment using the male aligning member and female alignment through-holes.

Turning next to FIGS. 10 and 13, the male stripping tool is also shown to include a spring loaded alignment cylinder 23 operatively arranged on the top surface of the male stripping tool and extending therethrough and through male stripping tool alignment opening diameter 21A, vertically downward. As specifically shown in FIG. 10, the spring loaded alignment cylinder includes at the top thereof a control knob 56, a barrel housing 58, a mounting member 59 having screw holes 59A and an alignment cylinder portion 24. Spring loaded alignment cylinder 23 can be incorporated into male alignment member 21 or used separately without alignment member 21. The alignment cylinder portion is adapted to be retracted or extracted through the barrel housing under a spring force by pulling and twisting of knob 56. Barrel 24 is of sufficient length such that it is adapted to extend through the male tool and female tool alignment openings upon extraction. The spring mechanism 35 is well known in the art. Moreover, it is not necessary that the alignment cylinder be, in fact, spring loaded, and it is sufficient if an operator is capable of extracting and retracting the cylinder upward and downward through the use of the control knob 56. As illustrated in FIG. 13, the spring loaded alignment cylinder is mounted on the upper surface of the male stripping tool through the use of screws and mounting holes 59A.

Alignment of the male and female stripping tools under the improved method provides that alignment cylinder 18 is placed through female stripping tool alignment opening 22A as shown in FIG. 14. After insertion, a test sheet is then urged in a manner typical to normal operation over the engaged alignment cylinder 18 and alignment opening 22A. If, in fact, the female stripping tool and test sheet are aligned, the test sheet will drop over the engaged alignment cylinder 18 and onto the lip 27 thereof as shown in FIG. 14. This can be easily visually detected by the operator. Once satisfied that alignment of each of the alignment cylinders, test sheet and female stripping tool alignment openings is achieved, the operator may then use alignment screws 31 and locking member 28 to position the female stripping tool in the "locked" position relative to the automatically urged position of the test sheet 14 and in the later production sheets. Alternatively, if the particular machine or press has other centering or locking means, the tool is "locked" in the relevant manner provided by the machine or press. Thus, the female stripping tool is aligned according to the position of the test sheet as determined by where it is urged over the female stripping tool. Once locked into position, however, the female stripping board and test sheet or resulting production sheet should be perfectly aligned. As well, each of the waste positions of the cut box blanks should be aligned over the female stripping tool portions 27 and edges 27A. The test sheet is now removed from the press.

Figure 12:
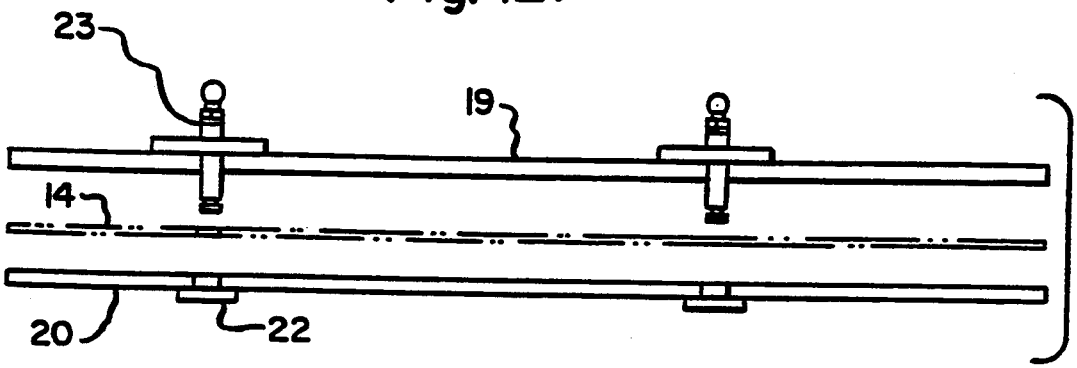
FIG. 12 is a partial sectional side elevation of a female tool, male tool with a sheet therebetween demonstrating engagement of the male alignment cylinder therethrough.

Adverting to FIGS. 12 and 13, the male stripping tool is aligned in a similar manner. In particular, the male stripping tool, after alignment of the female stripping tool and the test sheet, is placed over the top of the female stripping tool in operating engagement. The operator then attempts to insert through the female stripping tool alignment openings 21A, the barrel 24 of spring loaded alignment cylinder 23 through the use of the control knob. If the barrel does not smoothly proceed through the female alignment openings, the male tool is slightly moved within the machine frame or by the manipulation of the alignment means, and in the case of the preferred embodiment, the alignment screws, and ultimately, the locking members are engaged to "lock" the male tool in position such that the alignment cylinder 23 is capable of having barrel 24 proceed easily through the female tool alignment opening. As such, each of the male stripping tool, female stripping tool and sheet are perfectly aligned and accordingly, the operative portions of the tools (i.e., the stripping edges) are also in position for accurate, efficient and proper stripping (or blanking) of the etched and cut box sheets.

The above alignment method is completed for each of the sequential pairs of tools present in the manufacturing process. Once each of the tools is aligned in accord with the urged position of the test sheet, then the entire machine is aligned and set-up for purposes of production. Since the urging means will pull each sheet into an identical position over the tools, once the machine is first aligned, there is no need to repeatedly align the machine or begin again until new dies are interposed into the machine frame. Depending upon the type of alignment means present in a particular machine, it may not even be necessary to realign the machine when different tools are inserted into the machine such as in the Bobst® center line system. As set forth above, the improved method contemplates alignment of the dies relative to the urged position of the sheets. Moreover, the interposition of alignment openings and the through-holes of the test sheet permit an operator to easily and quickly align each of the tools using the alignment cylinders. After alignment is achieved, the tools may be locked into position using the positioning screws and locking member of the machine frame or the applicable locking means of the pertinent machine.

FIGS. 12 and 13 graphically illustrate the critical portions of the alignment method showing interposition of the test sheet between a female and male tool and the use of the alignment cylinder barrel for aligning the tools through each of the through-holes of the test sheet and the aligning openings of the male and female tools.

Accordingly, the improved method of aligning and setting up well-known box blank generating machinery provides a efficient and accurate method of insuring alignment based upon the position of the test sheet as it is automatically urged through the process. Moreover, the improved method includes an objective means for assessing whether the tools and test sheet are, in fact aligned; i.e., the use of the alignment cylinders that can be visually perceived and confirmed by the operator without error. Moreover, the method employs the typical locking apparatus of the well-known machinery to insure once alignment is achieved, the machine is set-up for later production runs without further alignment or refinement. Moreover, the method is perfectly adaptable to all types of alignment and locking methods known in the art.

I claim:

1. A method for aligning a die-cutting machine for cutting of box blanks from preselected material, comprising the steps of:

providing a cutting tool having a cutting surface:, said cutting tool adapted to be flexibly arranged in said die-cutting machine for cutting box blanks of preselected dimension from planar sheets of said material;

providing a planar test sheet of said material;

providing a plurality of alignment cutting cylinders interposed along said cutting surface of said cutting tool and adapted to selectively through-cut said planar test sheet at predetermined locations thereon;

through-cutting said planar test sheet with said cutting cylinders forming through-holes;

providing a paired female and male tool each having a work surface, and each adapted to be inserted into said die-cutting machine and further adapted to operatively engage one another;

placing said planar test sheet having said through-holes in operative arrangement with said female tool and said male tool;

providing a series of aligning means along said work surface of said female tool and substantially in alignment with said through-holes;

providing a series of aligning means along said work surface of said male tool and substantially in alignment with said through-holes of said planar test sheet and said aligning means of said female tool;

providing an alignment member adapted to be simultaneously passed through one of each of said substantially aligned female tool and male tool aligning means and said through-holes, provided each of said female tool and male tool aligning means and through-holes are properly vertically aligned;

providing a plurality of alignment locking means for said female tool and said male tool, said alignment locking means adapted to vary the orientation of said female tool and said male tool in said die-cutting machine and to lock said female tool and said male tool in position;

aligning said female tool and said male tool by ensuring said alignment member clearly passes through said female tool and said male tool aligning means and said through-holes;

locking said female tool and said male tool in position through said alignment locking means;

providing a planar production sheet of said material;

removing said female tool and said male tool aligning means from operative engagement with said female tool and said male tool, and removing said cutting cylinders from operative engagement with said cutting tool;

conducting a production run by urging said planar production sheet through said cutting tool and said aligned female tool and said male tool.

2. The method according to claim 1 wherein each said cutting cylinder comprises a cylindrical tube having, at one end, a cutting edge and adapted to be interposed along said cutting surface of said cutting tool such that said cutting edge protrudes above said surface of said cutting tool.

3. The method according to claim 1 wherein said female tool aligning means and said male tool aligning means comprise a plurality of cylindrical openings interposed along said surface of said male and female tools and wherein each said aligning means cylindrical opening has a diameter approximately equal to said cutting cylinder.

4. The method according to claim 1 wherein said alignment member is a cylindrical mandrel of preselected diameter adapted to be inserted through said aligning means of said male and female tools.

5. The method according to claim 1 wherein said alignment member is a spring-loaded mandrel arranged on said male or female tool surface and adapted to be automatically inserted through said aligning means of said male and female tools.

6. The method according to claim 1 wherein said alignment locking means comprise a series of screws on said die-cutting machine adapted to selectively position said tools and lock said tools in place.

* * * * *